US005907965A

United States Patent [19]

Krausser

[11] Patent Number: 5,907,965

[45] Date of Patent: Jun. 1, 1999

[54] DEVICE FOR EXPANDING A TUBE

[75] Inventor: Peter Krausser, Fürth, Germany

[73] Assignee: Siemens Aktiengesellschaft, Munich, Germany

[21] Appl. No.: 08/968,347

[22] Filed: Nov. 12, 1997

Related U.S. Application Data

[63] Continuation of application No. PCT/DE96/00799, May 9, 1996.

[30] Foreign Application Priority Data

May 11, 1995 [DE] Germany ..... 19517379

[51] Int. Cl.[6] ..... B21D 39/08

[52] U.S. Cl. ..... 72/58; 72/62

[58] Field of Search ..... 72/58, 62, 370.06, 72/370.22; 277/545, 547

[56] References Cited

U.S. PATENT DOCUMENTS

| | | | |
|---|---|---|---|
| 770,483 | 9/1904 | Tippett . | |
| 1,083,151 | 12/1913 | Steinbrueck . | |
| 1,631,520 | 6/1927 | Creevy . | |
| 2,850,311 | 9/1958 | Mansfield | 288/13 |
| 4,368,571 | 1/1983 | Cooper, Jr. | 29/421 R |
| 4,422,317 | 12/1983 | Mueller | 72/58 |
| 4,513,497 | 4/1985 | Finch | 29/727 |
| 4,513,506 | 4/1985 | Vogeleer | 33/147 K |
| 4,616,392 | 10/1986 | Snyder | 29/283.5 |
| 4,724,693 | 2/1988 | Tedder | 72/58 |
| 4,761,981 | 8/1988 | Kelly | 72/58 |
| 4,771,526 | 9/1988 | Arzenti et al. | 29/157.4 |
| 4,791,796 | 12/1988 | Ford | 72/62 |
| 4,876,871 | 10/1989 | Arzenti et al. | 72/122 |
| 5,009,002 | 4/1991 | Kelly | 29/890.031 |
| 5,062,199 | 11/1991 | Kelly | 29/727 |

FOREIGN PATENT DOCUMENTS

| | | |
|---|---|---|
| 0314267A2 | 5/1989 | European Pat. Off. . |
| 0468076A1 | 1/1992 | European Pat. Off. . |

*Primary Examiner*—Joseph J. Hail, III
*Assistant Examiner*—William Hong
*Attorney, Agent, or Firm*—Herbert L. Lerner; Laurence A. Greenberg

[57] ABSTRACT

An apparatus for expanding a tube includes a probe to be introduced into the tube. The probe includes an elastic expansion sleeve that can be acted upon by a pressure medium over at least a portion of its inner surface. The expansion sleeve is provided on its outer periphery with a support ring which is supported on a shoulder of the probe that surrounds the expansion sleeve. The support ring is formed by at least two partial segments that are movable relative to one another. This assures that the support ring can reversibly follow a change in diameter that takes place when the expansion sleeve is expanded, thereby preventing the expansion sleeve from being pinched and caught in a gap located between the tube and the probe.

4 Claims, 2 Drawing Sheets

DEVICE FOR EXPANDING A TUBE

CROSS-REFERENCE TO RELATED APPLICATION

This application is a Continuation of International Application Serial No. PCT/DE96/00799, filed May 9, 1996.

BACKGROUND OF THE INVENTION

Field of the Invention

The present invention relates to an apparatus for expanding a tube.

Published European Patent Application 0 468 076 A1 discloses an apparatus for expanding a tube, which includes a probe that can be introduced into the tube and has a radially expandable expansion sleeve made of an elastically deformable material. The expansion sleeve is braced by each of its ends on one shoulder of a receiving sleeve. The receiving sleeves are joined together by a tie rod and axially fixed in opposed directions. The tie rod is passed through the expansion sleeve and together with recesses in the expansion sleeves it forms annular recesses that each receive one end of the expansion sleeve. The expansion sleeve is acted upon over a portion of its inside surface with a pressure medium passing through bores in the tie rod. The expansion sleeve is provided with an annularly encompassing groove for receiving an O-ring on the outer periphery in the region of the end surface of the receiving sleeves, which end surface annularly surrounds the expansion sleeve. The O-rings are intended to guard the expansion sleeve against damage, should it be pinched into voids that are located between the receiving sleeves and the tube which is to be expanded, when pressure is imposed.

On one hand, the O-ring used in the known device must have adequate elastic properties in order to spring back to its original shape after the imposition of pressure. On the other hand, it must also have adequate mechanical strength in order to absorb axial forces that act upon it when pressure is imposed.

O-rings made of a material that is elastically deformable within the course of deformation until it rests against the inner wall of the tube, such as O-rings of a polymeric material, for example, are unable to absorb those high axial forces, so that when such O-rings are used, the expansion sleeve is pinched in an annular interstice between the tube and the receiving sleeve and can become irreversibly deformed as a result. That not only causes damage to the expansion sleeve but also makes it harder to recover the probe once the expansion has been accomplished.

However, if an O-ring of an inelastic material or a material with a small range of elasticity is used, there is the risk of permanent plastic deformation, which again means that the probe can only be recovered from the tube with very great difficulty, if at all.

It has been found that the contradictory demands for elasticity and strength of such a support ring can only be inadequately met, if at all, by all of the materials that may be considered.

In order to avoid the above-discussed problems, Published European Patent Application 0 314 267 A2, corresponding to U.S. Pat. No. 4,791,796, proposes using two metal support rings that are made of many segments which are displaceable relative to one another. Each of the rings is held together by an elastic ring and the rings are disposed side by side. Those segments can slide against one another on the former end surfaces which are then oriented toward one another, so that once the expansion sleeve has been expanded one of the support rings rests on the tube, while the other support ring rests on a shoulder serving as a boundary. As a result of the two support rings being disposed side by side and partly overlapping one another as seen in an axial plan view, the expansion sleeve is largely prevented from becoming pinched in the axial direction in the interstice between the tube and the expansion apparatus, or between the segments.

SUMMARY OF THE INVENTION

It is accordingly an object of the invention to provide an apparatus for expanding a tube, which overcomes the hereinafore-mentioned disadvantages of the heretofore-known devices of this general type, which reversibly resumes its original shape as extensively as possible once the expansion has been accomplished so that recovery of the apparatus after the expansion process is easily possible, and which moreover is simple in construction.

With the foregoing and other objects in view there is provided, in accordance with the invention, an apparatus for expanding a tube, comprising a probe to be introduced into a tube, the probe including an elastic expansion sleeve, the expansion sleeve having an inner surface to be acted upon over at least a portion of the inner surface by a pressure medium, and the expansion sleeve having an outer periphery; a shoulder of the probe surrounding the expansion sleeve; and a support ring disposed on the outer periphery of the expansion sleeve and supported on the shoulder, the support ring having at least two mutually movable partial segments with overlapping ends facing toward one another.

It is assured by this provision that the support ring can reversibly follow the change in diameter which occurs upon expansion of the expansion sleeve, so that pinching of the expansion sleeve in a gap present between the tube and the probe is avoided. Since the overlapping partial segments mesh with one another, the creation of interstices between the partial segments in their radially outwardly-oriented displacement is also prevented. In this way, once again, the expansion sleeve cannot become pinched between the partial segments.

In accordance with another feature of the invention, the partial segments have a groove on their outer periphery for receiving an elastic O-ring. This provision assures that the partial segments are restored to the original radius again, once the expansion has occurred or in other words once the expansion sleeve has been pressure-relieved.

In accordance with a further feature of the invention, at least one partial segment has an extension on its end at the groove bottom that can be inserted into a corresponding recess located on the inner periphery of the adjoining partial segment.

In accordance with a concomitant feature of the invention, the end of at least one partial segment is provided on the sides of the groove with one extension each, which can be inserted into recesses in the side wall of the adjoining partial segment. As a result of this provision, even after the expansion, the partial segments form a closed ring, which both radially and axially prevents the expansion sleeve from being pinched outward.

Other features which are considered as characteristic for the invention are set forth in the appended claims.

Although the invention is illustrated and described herein as embodied in a device for expanding a tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
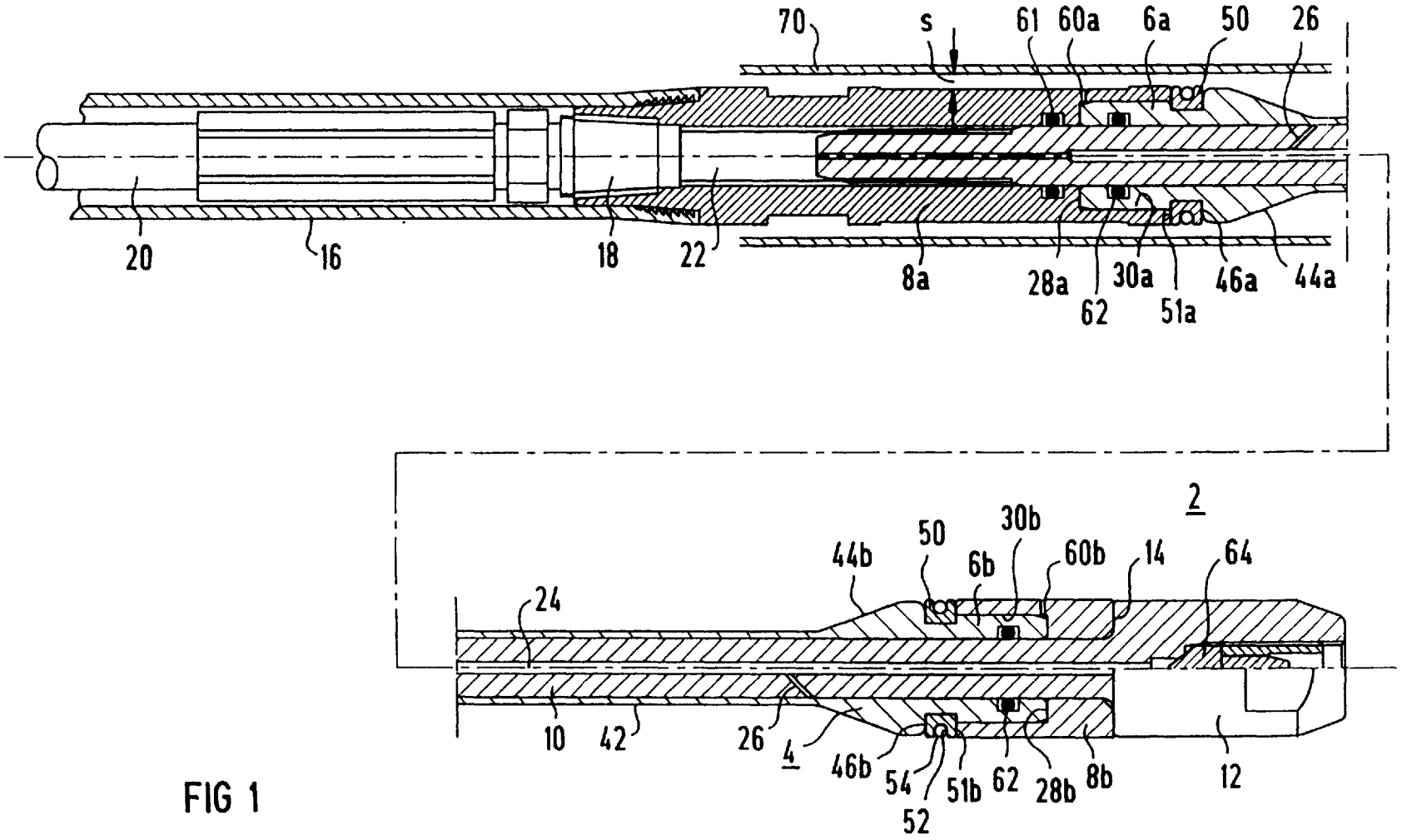
FIG. 1 is a fragmentary, diagrammatic, longitudinal-sectional view of an apparatus according to the invention.

Referring now to the figures of the drawings in detail and first, particularly, to FIG. 1 thereof, there is seen an apparatus for expanding a tube which includes a probe 2 that carries an expansion sleeve 4 of a material of high elastic deformability, preferably an elastomer with a hardness between 90 Shore and 100 Shore, such as FIBROFLEX (which is a trademark of the company known as Fibro). The expansion sleeve 4 has ends 6*a* and 6*b* respectively supported in a receiving sleeve 8*a* on a connection side and a receiving sleeve 8*b* on an end surface.

A tie rod 10 is screwed into the receiving sleeve 8*a*, and the receiving sleeve 8*b* and the expansion sleeve 4 are slipped onto the tie rod 10. The tie rod 10 has a free end remote from the receiving sleeve 8*a* which is fixed in a head part 12 that is provided with a shoulder 14 on which the end-surface receiving sleeve 8*b* is supported.

The receiving sleeve 8*a* on the connection side is fixed to a guide tube 16 and provided with a connection 18 for a pressure medium, which is delivered to a hollow space 22 in the interior of the receiving sleeve 8*a* through a high-pressure hose 20.

The tie rod 10 is provided with a central bore 24, into which channels 26 leading to the outer surface of the tie rod 10 discharge in the region of the expansion sleeve 4.

The receiving sleeves 8*a* and 8*b* are provided with annular recesses, which form respective cylindrical annular chambers 30*a* and 30*b* together with the tie rod 10. The respective ends 6*a* and 6*b* of the expansion sleeve 4 are introduced into these annular chambers 30*a* and 30*b* and the expansion sleeve 4 has respective end surfaces 28*a* and 28*b* supported axially on bottoms of these annular chambers 30*a* and 30*b*.

The expansion sleeve 4 includes a central region 42 having approximately constant, slight wall thickness, which is adjoined by respective regions 44*a* and 44*b* of increasing wall thickness and increasing outer diameter. The regions 44*a* and 44*b* are respectively joined by the ends 6*a* and 6*b* having an approximately constant outer diameter and opening into the recesses 30*a* and 30*b*.

The expansion sleeve 4 has an outer periphery provided with respective annular grooves 46*a* and 46*b* at the level of the end surfaces of the receiving sleeves 8*a* and 8*b* which face one another. One support ring 50 is placed in each of the annular grooves 46*a* and 46*b*. According to the invention, each of the support rings 50 is composed of two or more partial segments shown in FIGS. 2–4, which are movable relative to one another. The grooves 46*a* and 46*b* have respective edges toward the receiving sleeves 8*a* and 8*b* which are disposed flush with the end surfaces of the receiving sleeves 8*a* and 8*b*, so that the support rings 50 rest with their side surfaces oriented toward the respective receiving sleeves 8*a* and 8*b*, on a respective shoulder 51*a* and 51*b* formed by the end surfaces of the receiving sleeves 8*a* and 8*b*.

The support rings 50 are each also provided with an annular groove 52, which contains an O-ring 54 for fixation of the support rings 50 in the grooves 46*a* and 46*b*. These O-rings 54 act as a spring element, which does not hinder displacement of partial segments of the support ring 50 when pressure is imposed and causes the partial segments to resume their original position once the pressure has been withdrawn.

Respective ventilation bores 60*a* and 60*b* on the bottom of the recesses 30*a* and 30*b* of the receiving sleeves 8*a* and 8*b* allow the expansion sleeve 4 to be put in place without play.

A sealing ring 61 placed in an internal groove of the receiving sleeve 8*a* prevents the escape of pressure medium into a region located between the expansion sleeve 4 and the receiving sleeve 8*a*.

A region between the tie rod 10 and the expansion sleeve 4 upon which pressure is exerted is defined by sealing rings 62 placed in internal grooves of the expansion sleeve 4.

The central bore 24 of the tie rod 10 is closed at an end surface of the head part 12 with a threaded pin 64 constructed as a sealing cone.

A gap s which is located between the receiving sleeves 8*a* and 8*b* and a tube 70 that is to be expanded, is necessary to enable introduction of the probe 2 into the tube 70. Upon expansion of the expansion sleeve 4, the danger is that the expansion sleeve 4 will become pinched in its peripheral region in the interstice formed by this gap s, between the receiving sleeves 8*a* and 8*b* and the tube 70.

This is prevented by the fact that the support ring 50 presses against the inner wall of the tube 70 and closes the gap s, when the expansion sleeve 4 expands.

Figure 2:
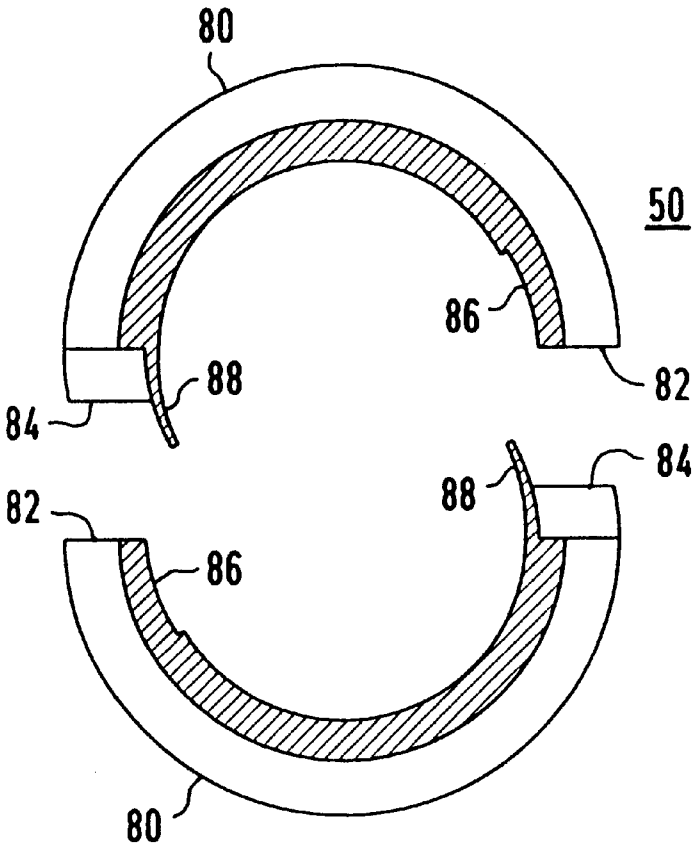
FIG. 2 is an enlarged, cross-sectional view of an especially preferred feature of a support ring according to the invention.

In FIG. 2, the support ring 50 is composed of two partial segments 80 in the form of half rings, which overlap at their ends 82 and 84 that face one another and mesh with one another. The partial segments 80 are movable relative to one another and can be displaced in the circumferential direction relative to one another. For that purpose, each partial segment 80 is provided on one end 82 with a recess 86 disposed at the inner periphery. The recess is engaged by an extension 88 disposed on the bottom of the groove 52, when the two partial segments 80 are put together. Due to the relatively thin-walled construction of the extension 88, largely gap-free sliding along the recess 86 is assured.

Figure 4:
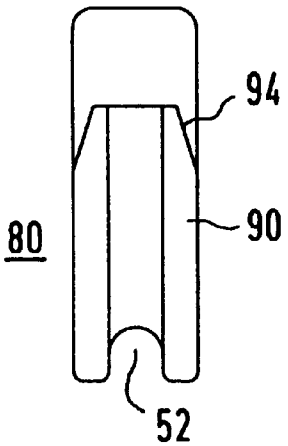
FIGS. 3 and 4 are side-elevational views of the support ring as seen from opposite directions, in a plane oriented at right angles to the sectional surface of FIG. 2.
Figure 3:
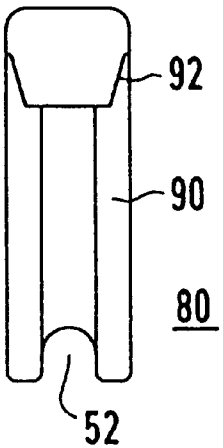

It can be seen in FIGS. 3 and 4 that side walls 90 of the groove 52 are again provided on one end 82 with an extension 92, that engages a corresponding recess 94 on the opposite end 84 of the other partial segment 80. Through the use of these provisions the partial segments 80 of the support ring 50 will have an adequate overlap to prevent the elastic material of the expansion sleeve 4 from becoming pinched between the partial segments 80, even when the expansion sleeve 4 expands. As a result of the elastic O-ring, which is not shown in FIGS. 3 and 4, but is placed in the groove 52, the partial segments 80 are displaced back into their original position after the expansion and permit easy recovery of the probe.

I claim:

1. An apparatus for expanding a tube, comprising:

a probe to be introduced into a tube, said probe including:

an elastic expansion sleeve, said expansion sleeve having an inner surface to be acted upon over at least a portion of said inner surface by a pressure medium, and said expansion sleeve having an outer periphery;

a shoulder surrounding said expansion sleeve; and a support ring disposed on said outer periphery of said expansion sleeve and supported on said shoulder, said support ring having at least two mutually movable partial segments with overlapping ends in a circumferential direction.

2. The apparatus according to claim 1, wherein said partial segments have an outer periphery with a groove formed therein for receiving an elastic O-ring.

3. The apparatus according to claim 1, wherein at least one of said partial segments has a groove with a bottom and an extension on said end at said bottom, and another of said partial segments has an inner periphery with a recess for receiving said extension.

4. The apparatus according to claim 1, wherein said partial segments have grooves formed therein defining side walls of said grooves, at least one of said partial segments has extensions on said ends at said side walls, and another of said partial segments has recesses in said side walls for receiving said extensions.

* * * * *